US010405607B2

(12) United States Patent
Pauk et al.

(10) Patent No.: US 10,405,607 B2
(45) Date of Patent: Sep. 10, 2019

(54) TENSIONING SYSTEM FOR AN ARTICLE OF FOOTWEAR

(71) Applicant: NIKE, Inc., Beaverton, OR (US)

(72) Inventors: Matthew R. Pauk, Portland, OR (US); Sebastian Tesche, Portland, OR (US); Brandon Workman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 588 days.

(21) Appl. No.: 15/077,102

(22) Filed: Mar. 22, 2016

(65) Prior Publication Data

US 2017/0273403 A1 Sep. 28, 2017

(51) Int. Cl.

| | |
|---|---|
| ***A43C 1/00*** | (2006.01) |
| ***A43B 23/02*** | (2006.01) |
| ***A43B 13/12*** | (2006.01) |
| ***A43B 13/14*** | (2006.01) |
| ***A43B 13/18*** | (2006.01) |
| ***A43B 23/07*** | (2006.01) |
| ***A43C 1/04*** | (2006.01) |
| ***A43B 9/00*** | (2006.01) |
| ***A43B 19/00*** | (2006.01) |

(52) U.S. Cl.

CPC ..... *A43B 23/026* (2013.01); *A43B 9/00* (2013.01); *A43B 13/12* (2013.01); *A43B 13/141* (2013.01); *A43B 13/181* (2013.01); *A43B 19/00* (2013.01); *A43B 23/0245* (2013.01); *A43B 23/07* (2013.01); *A43C 1/04* (2013.01)

(58) Field of Classification Search

CPC ..... A43B 23/026; A43B 23/0245; A43B 23/0265; A43B 13/181; A43B 13/141; A43B 13/12; A43B 23/07; A43C 1/003; A43C 1/04; A43C 1/006

USPC ..... 36/50.1

See application file for complete search history.

(56) References Cited

U.S. PATENT DOCUMENTS

| | | | | | |
|---|---|---|---|---|---|
| 4,811,500 | A * | 3/1989 | Maccano | A43B 5/00 | 36/117.9 |
| 5,377,430 | A * | 1/1995 | Hatfield | A43B 3/08 | 24/714.6 |
| 5,992,057 | A * | 11/1999 | Monti | A43B 5/02 | 36/50.1 |
| 7,159,340 | B2 * | 1/2007 | Borsoi | A43B 5/0405 | 36/10 |
| 8,215,033 | B2 * | 7/2012 | Carboy | A43B 1/0072 | 36/117.1 |
| 8,959,799 | B2 * | 2/2015 | Nishiwaki | A43B 7/1495 | 36/50.1 |
| 2004/0205982 | A1 * | 10/2004 | Challe | A43B 9/02 | 36/55 |

(Continued)

OTHER PUBLICATIONS

Jun. 20, 2017—(WO) ISR & WO—App. No. PCT/US17/023192.

*Primary Examiner* — Katharine Gracz

(74) *Attorney, Agent, or Firm* — Banner & Witcoff, Ltd.

(57) ABSTRACT

An article of footwear can include a tensioning system with a multilayered upper and a relatively narrow strobel. One layer of the upper can be attached to an outer periphery of the strobel. Another layer of the upper can be attached to a portion of the sole structure. In addition, a lacing region can be formed by folding a laminated structure including the second layer. A third layer of the upper can provide a bootie within the article of footwear configured to receive a foot.

19 Claims, 11 Drawing Sheets

(56) References Cited

U.S. PATENT DOCUMENTS

| | | | | |
|---|---|---|---|---|
| 2004/0250452 | A1* | 12/2004 | Farys | A43B 5/002 36/89 |
| 2006/0117606 | A1* | 6/2006 | Chen | A43B 7/223 36/50.1 |
| 2009/0277043 | A1* | 11/2009 | Graser | A43B 7/1495 36/91 |
| 2010/0263236 | A1* | 10/2010 | Carboy | A43B 1/0072 36/117.1 |
| 2011/0113648 | A1* | 5/2011 | Leick | A43B 1/0081 36/50.1 |
| 2012/0011744 | A1 | 1/2012 | Bell et al. | |
| 2012/0198730 | A1* | 8/2012 | Burch | A43B 23/0245 36/30 R |
| 2013/0019500 | A1* | 1/2013 | Greene | A43B 23/025 36/50.1 |
| 2013/0104422 | A1* | 5/2013 | Hatfield | A43B 5/001 36/103 |
| 2013/0219749 | A1* | 8/2013 | Dojan | A43B 23/0265 36/83 |
| 2016/0345660 | A1* | 12/2016 | Chen | A43B 13/14 |

* cited by examiner

TENSIONING SYSTEM FOR AN ARTICLE OF FOOTWEAR

BACKGROUND

The present embodiments relate generally to articles of footwear and a tensioning system for use with the articles of footwear.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, the present disclosure is directed to an article of footwear, the article of footwear comprising a forefoot region, a midfoot region, a heel region, a lateral side, and a medial side, an upper, a sole structure, and a strobel. In addition, the sole structure includes a proximal sole surface, the proximal sole surface facing toward an interior cavity of the article of footwear, and the strobel is attached to a central sole portion of the proximal sole surface. The upper is comprised of an interior component and an exterior component, the interior component comprising a bootie being configured to receive a foot, where a first bottom edge of the interior component is attached to a peripheral edge of the strobel. Furthermore, the exterior component comprises a first layer, a second layer, and two laminated structures, where the first layer forms an exterior-facing surface of the article of footwear. The second layer is disposed between the interior component and the first layer, where a second bottom edge of the second layer is attached to the peripheral edge of the strobel, the second bottom edge of the second layer being disposed adjacent to the first bottom edge of the interior component.

In another aspect, the present disclosure is directed to an article of footwear, the article of footwear comprising a forefoot region, a midfoot region, and a heel region, an upper, a sole structure, and a strobel. The sole structure includes a proximal sole surface, the proximal sole surface facing toward an interior cavity of the article of footwear, and the proximal sole surface comprising a medial sole portion, a central sole portion, and a lateral sole portion. The central sole portion extends between the medial sole portion and the lateral sole portion. The strobel is attached to the central sole portion of the proximal sole surface. In addition, the upper comprises an outer layer, an intermediate layer, and an inner layer, where a majority of the intermediate layer is disposed between the outer layer and the inner layer. The inner layer forms a bootie, the bootie being configured to receive a foot, and the outer layer comprises a medial upper portion, a covering portion, and a lateral upper portion. Furthermore, the medial upper portion of the outer layer is attached to the medial sole portion of the proximal sole surface, and the lateral upper portion of the outer layer is attached to the lateral sole portion of the proximal sole surface, the lateral upper portion being disposed adjacent to a lateral peripheral edge of the strobel and the medial upper portion being disposed adjacent to a medial peripheral edge of the strobel. The intermediate layer comprises a medial attachment portion and a lateral attachment portion, where the lateral attachment portion is attached adjacent to the lateral peripheral edge of the strobel, and the medial attachment portion is attached adjacent to the medial peripheral edge of the strobel. The intermediate layer further comprises a medial side portion and a lateral side portion, the medial side portion including a medial free portion and a medial laminated portion, the medial free portion extending from the medial attachment portion to the medial laminated portion. The medial laminated portion is disposed within a medial laminated structure.

In another aspect, the present disclosure is directed to an article of footwear, the article of footwear comprising a forefoot region, a midfoot region, and a heel region, an upper, a sole structure, and a strobel. The sole structure includes a proximal sole surface, the proximal sole surface facing toward an interior cavity of the article of footwear, and the strobel being attached to a central sole portion of the proximal sole surface. In addition, the upper comprises an interior component and an exterior component, the interior component comprising a bootie being configured to receive a foot, and a first bottom edge of the interior component being attached to a peripheral edge of the strobel. The exterior component comprises a first layer, a second layer, and two laminated structures, where the first layer forms an exterior-facing surface of the article of footwear, and where a first edge of the first layer is disposed adjacent to a second edge of the second layer. Furthermore, the second layer is disposed between the interior component and the first layer, where a second bottom edge of the second layer is attached to the peripheral edge of the strobel, and the second bottom edge of the second layer is disposed adjacent to the first bottom edge of the interior component. In addition, the first layer extends through the forefoot region, the midfoot region, and the heel region, and the second layer extends through the midfoot region and heel region.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
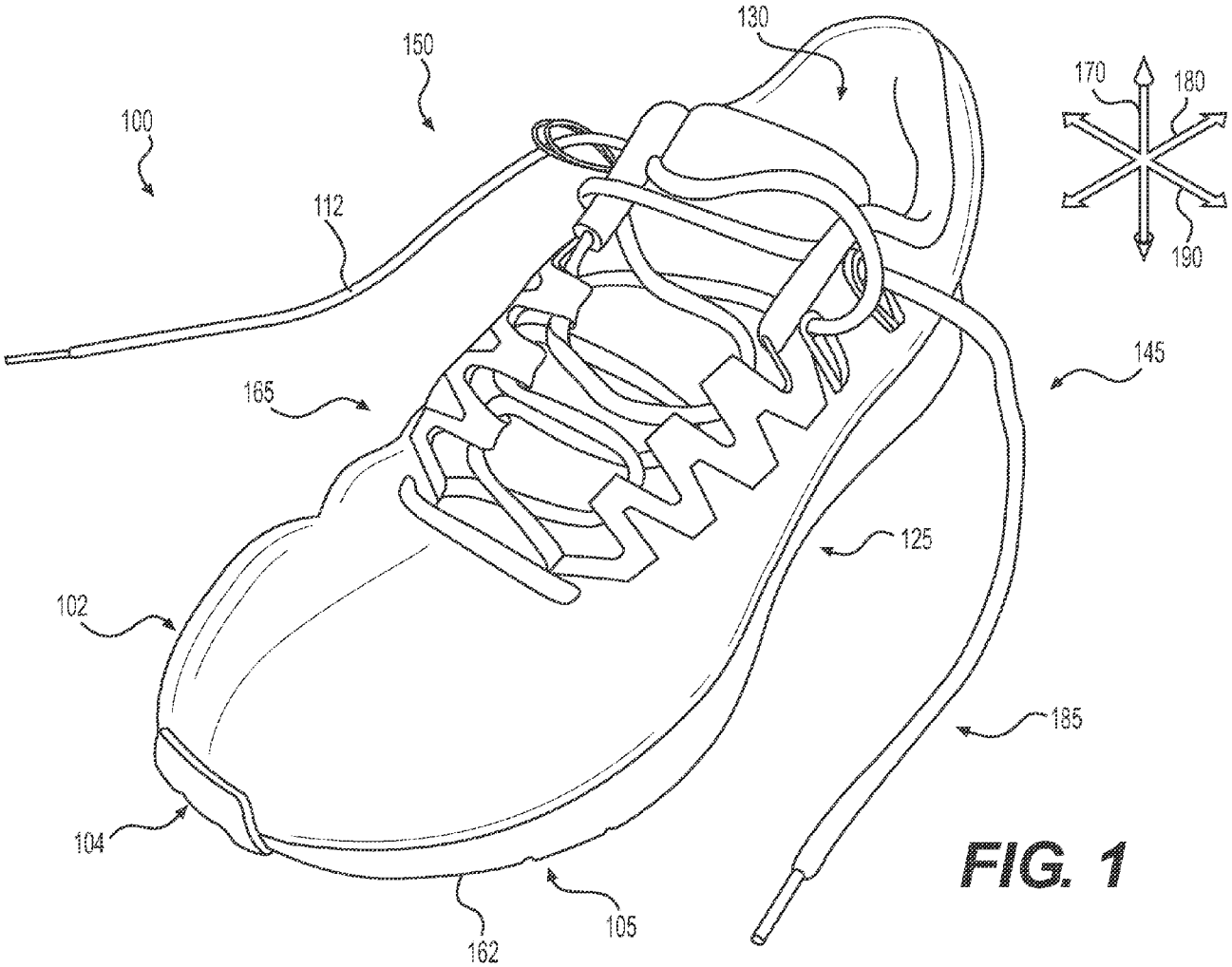
FIG. 1 is an isometric view of an embodiment of an article of footwear.

The following discussion and accompanying figures disclose articles of footwear and a method of assembly of an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe's interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

Referring to FIG. 1, an isometric side view of an article of footwear ("article") 100 that is configured with a tensioning system 150 is depicted. In the current embodiment, article 100 is shown in the form of an athletic shoe, such as a running shoe. However, in other embodiments, tensioning system 150 may be used with any other kind of footwear including, but not limited to, hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports-related footwear, including, but not limited to, slippers, sandals, high-heeled footwear, loafers as well as any other kinds of footwear. As discussed in further detail below, a tensioning system may not be limited to footwear and in other embodiments a tensioning system and/or components associated with a tensioning system could be used with various kinds of apparel, including clothing, sportswear, sporting equipment and other kinds of apparel. In still other embodiments, a tensioning system may be used with braces, such as medical braces.

As noted above, for consistency and convenience, directional adjectives are employed throughout this detailed description. Article 100 may be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100 but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot region 105 to a heel region 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

Article 100 may include upper 102 and sole structure 104. Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

As shown in FIG. 1, upper 102 may include one or more material elements (for example, meshes, textiles, foam, leather, and synthetic leather), which may be joined to define an interior cavity configured to receive a foot of a wearer. The material elements may be selected and arranged to impart properties such as light weight, durability, air permeability, wear resistance, flexibility, and comfort. Upper 102 may define an opening 130 through which a foot of a wearer may be received into the interior cavity. As will be discussed further below with respect to FIG. 4, in some embodiments, upper 102 may comprise a plurality of components and/or layers that help provide a tensioning system to the article of footwear.

At least a portion of sole structure 104 may be fixedly attached to portions of upper 102 (for example, with adhesive, stitching, welding, or other suitable techniques) and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running, or other ambulatory activities. The configuration of sole structure 104 may vary significantly in different embodiments to include a variety of conventional or nonconventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is hard or soft. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole. In addition, in some cases, sole structure 104 can include one or more cleat members or traction elements that are configured to increase traction with the ground's surface.

In some embodiments, sole structure 104 may include multiple components, which may, individually or collectively, provide article 100 with a number of attributes, such as support, rigidity, flexibility, stability, cushioning, comfort, reduced weight, or other attributes. In some embodiments, sole structure 104 may include an insole/sockliner, a midsole, and a ground-contacting outer sole member ("outsole") 162, which may have an exposed, ground-contacting lower surface. In some cases, however, one or more of these components may be omitted.

The "interior" of a shoe refers to space that is occupied by a wearer's foot when the shoe is worn. The "inner side" of a panel or other shoe element refers to the face of that panel or element that is (or will be) oriented toward the shoe's interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or upper. Thus, the terms proximal and distal may be understood to provide generally opposing terms to describe the relative spatial position of a footwear layer.

Furthermore, throughout the following description, the various layers or components of sole structure 104 may be described with reference to a proximal side and a distal side. In embodiments in which upper 102 and/or sole structure 104 comprise multiple layers (as will be discussed further below), the proximal side will refer to the surface or side of the specified layer that faces the upper and/or faces toward the foot-receiving interior cavity formed in the article. In addition, the distal side will refer to a side of the layer that is opposite to the proximal side of the layer. In some cases, the distal side of a layer is associated with the outermost surface or side. Thus, a proximal side may be a side of a layer of sole structure 104 that is configured to face upward, toward a foot or a portion of an upper. A distal side may be a surface side of a layer of sole structure 104 that is configured to face toward a ground surface during use of the article.

Furthermore, the "interior" of a shoe refers to space that is occupied by a wearer's foot when the shoe is worn. The "inner side" of a panel or other shoe element refers to the face of that panel or element that is (or will be) oriented toward the shoe's interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or upper. Thus, the terms proximal and distal may be understood to provide generally opposing terms to describe the relative spatial position of a footwear layer.

In addition, throughout the following description, the various layers or components of sole structure 104 may be described with reference to a proximal side and a distal side. In embodiments in which sole structure 104 comprises multiple layers (as will be discussed further below), the proximal side will refer to the surface or side of the specified layer that faces the upper and/or faces toward the foot-receiving interior cavity formed in the article. In addition, the distal side will refer to a side of the layer that is opposite to the proximal side of the layer, and/or is disposed relatively further from the interior cavity formed by the article of footwear. In some cases, the distal side of a layer is associated with the outermost surface or side. Thus, a proximal side may be a side of a layer of sole structure 104 that is configured to face upward, toward a foot or a portion of an upper. A distal side may be a surface side of a layer of sole structure 104 that is configured to face toward a ground surface during use of the article.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, as noted above, in different embodiments, article 100 may include tensioning system 150. Tensioning system 150 may comprise various components and systems for adjusting the size of opening 130 leading to an interior cavity, and tightening (or loosening) upper 102 around a wearer's foot. In some embodiments, tensioning system 150 may comprise one or more laces, as well as a motorized tensioning device. A lace or a tensile element 112 as used with article 100 may comprise any type of lacing material known in the art. Examples of laces that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township, N.J., although other kinds of extended chain, high modulus polyethylene fiber materials can also be used as a lace. The arrangement of the lacing depicted in the Figures is only intended to be exemplary, and it will be understood that other embodiments are not limited to a particular configuration for lacing elements. Furthermore, it should be understood that the embodiments described herein with respect to the layers or components of upper 102 may be applicable to articles that do not include a tensioning system.

Figure 2:
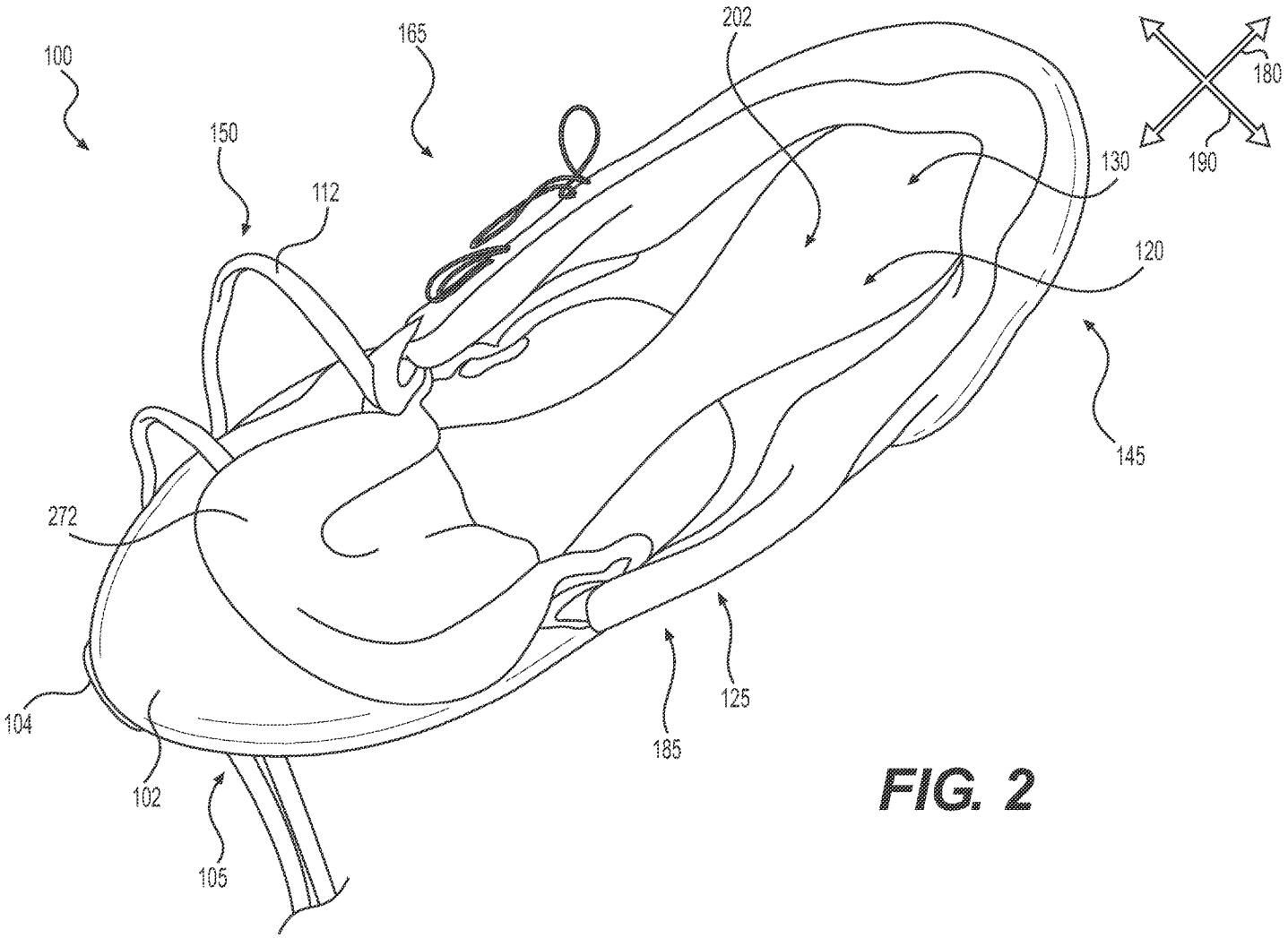
FIG. 2 is a top-down isometric view of an embodiment of an article of footwear.

In addition, in some embodiments, article 100 may include provisions for providing a stable surface along the interior of article 100. In some embodiments, a base component may be disposed in the void defined by upper 102. Referring to the isometric top-down view of FIG. 2, a base component 120 may be generally positioned between the foot of a wearer and sole structure 104 when article 100 is worn by a wearer. As will be discussed further below, in some embodiments, base component 120 may be secured to a lower portion of upper 102 as well as an upper portion of sole structure 104. In one embodiment, as shown in the embodiment of FIG. 2, base component 120 may be secured to a top or proximal sole surface ("proximal surface") of sole structure 104 (see FIG. 3). In some embodiments, base component 120 may comprise a strobel element (also referred to as a strobel layer, or just a strobel) that is configured to be fixedly attached to sole structure 104. As used herein, a strobel may be any element, layer, member, component or other structure that facilitates in attaching an upper to a sole structure.

In some embodiments, base component 120 may be disposed between portions of tensioning system 150 and sole structure 104. In one embodiment, portions of tensioning system 150 may be secured or attached to base component 120. In an exemplary embodiment, portions of tensioning system 150 may be secured to base component 120 in a manner such that tensioning system 150 is selectively decoupled from one or more portions of sole structure 104. In other words, as will be discussed further below, in some embodiments, tensioning system 150 may be selectively decoupled from portions of sole structure 104 by securing various layers or components of upper 102 to a periphery of base component 120 along an attachment area that has a narrower width than the width of sole structure 104.

Base component 120 may be fixedly attached to sole structure 104, for example, through stitching, adhesive bonding, thermal bonding (such as welding), or other techniques, or may be integral with sole structure 104. Base component 120 may be formed from any suitable material having the properties described above, according to the activity for which article 100 is intended. In some embodiments, portions of base component 120 may be exposed within an interior cavity 202 of article 100, as shown in FIG. 2. In other embodiments, base component 120 may be partially or completely covered by other elements, such as material layers from upper 102 or an insole. For example, in some embodiments, base component 120 may be disposed adjacent to or below a bootie disposed inside of interior cavity of article 100.

Furthermore, as shown in FIG. 2, article 100 may include a tongue 272, which may be provided near or along a throat opening. In some embodiments, tongue 272 may be provided in or near an instep region of article 100. However, in other embodiments, tongue 272 may be disposed along other portions of an article of footwear, or an article may not include a tongue.

Figure 3:
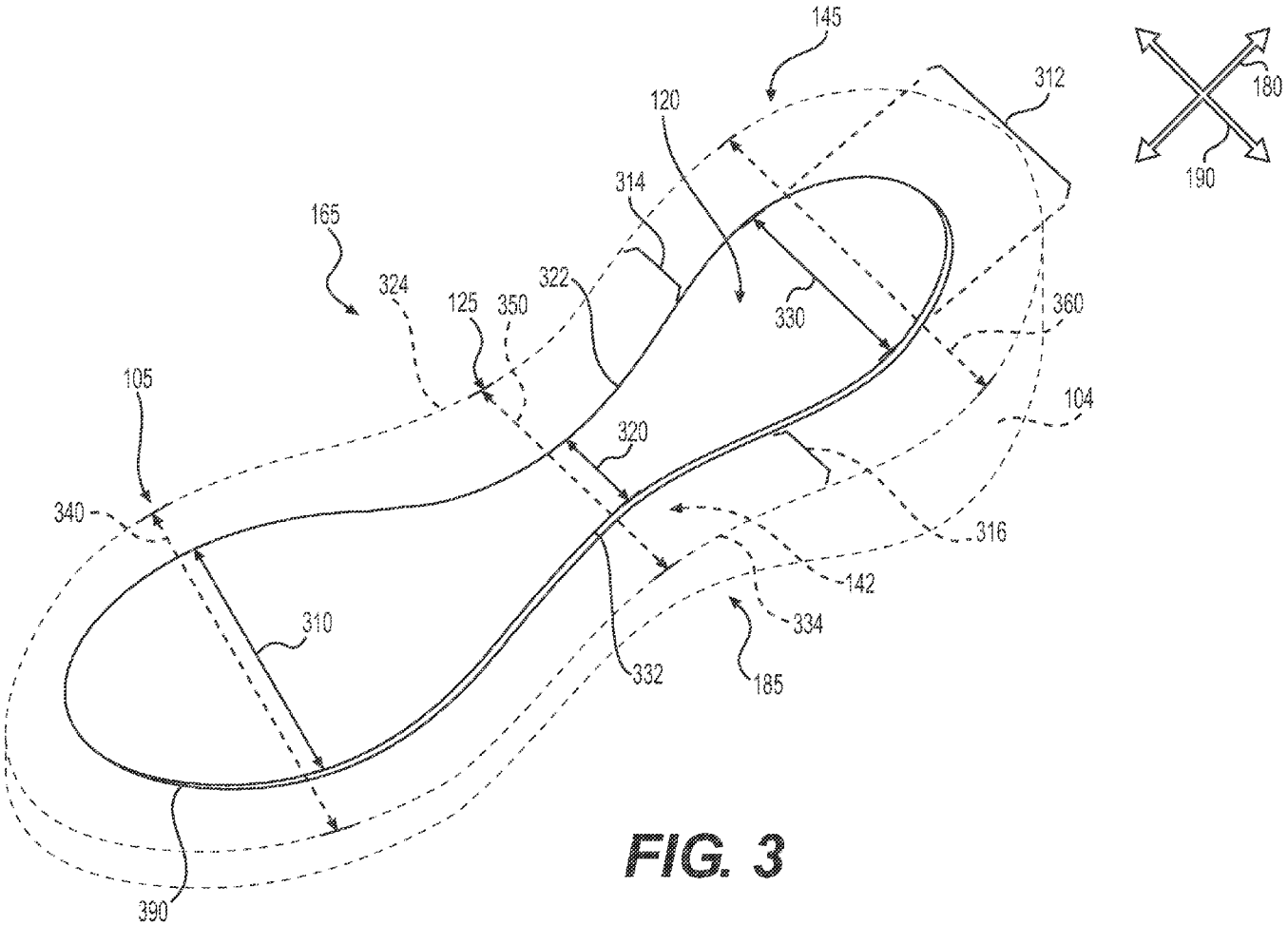
FIG. 3 is a top-down view of an embodiment of a strobel with a sole structure.

For purposes of illustration, an isolated view of base component 120 is depicted in FIG. 3, with sole structure 104 depicted below base component 120 in dotted line. As shown in FIG. 3, base component 120 may extend through each of forefoot region 105, midfoot region 125, and heel region 145, and between lateral side 185 and medial side 165 of article 100 in some embodiments. In other embodiments, base component 120 may be disposed primarily along medial side 165 or primarily along lateral side 185. As shown in FIG. 3, a distal side of base component 120 is disposed on top of a proximal surface 142 of sole structure 104.

In different embodiments, the dimensions of base component 120 can vary. In some embodiments, base component 120 has a peripheral border 390 that is associated with the outer boundary or perimeter of base component 120. As shown in FIG. 3, base component 120 can include a first width 310 in forefoot region 105, a second width 320 in midfoot region 125, and a third width 330 in heel region 145. In some embodiments, first width 310, second width 320, and third width 330 can differ with respect to one another. For example, second width 320 is substantially smaller than first width 310 in FIG. 3. In addition, second width 320 is also substantially smaller than third width 330 in FIG. 3. In some embodiments, first width 310 and third width 330 can be similar, though in one embodiment, first width 310 can be greater than third width 330.

Furthermore, the width of base component 120 can vary relative to proximal surface 142 of sole structure 104 in different embodiments. In FIG. 3, proximal surface 142 has a fourth width 340 in forefoot region 105, a fifth width 350 in midfoot region 125, and a sixth width 360 in heel region 145. In some embodiments, fourth width 340, fifth width 350, and sixth width 360 can differ with respect to one another. For example, fifth width 350 is somewhat smaller than either fourth width 340 or sixth width 360 in FIG. 3. As noted above, in some embodiments, base component 120 can differ in size and dimensions relative to proximal surface 142. In FIG. 3, it can be seen that second width 320 of base component 120 is substantially smaller than fifth width 350 of proximal surface 142. In some embodiments, midfoot region 125 of base component 120 can overlap between 20% and 90% of midfoot region 125 of proximal surface 142. In one embodiment, the area of base component 120 in midfoot region 125 can be between 30% and 70% of the area of proximal surface 142 in midfoot region 125. In other words, in different embodiments, there may be regions or portions of proximal surface 142 that are not joined to or contacting base component 120.

In FIG. 3, for purposes of reference, proximal surface 142 can be understood to include a central sole portion 312, a medial sole portion 314, and a lateral sole portion 316. Central sole portion 312 of proximal surface 142 is the area of proximal surface 142 that is covered by, in contact with, and/or is fixedly attached to) base component 120. In one embodiment, central sole portion 312 is smaller than the area comprising proximal surface 142. For example, as the dimensions of base component 120 are smaller than that of proximal surface 142, in some embodiments, there may be regions of proximal surface 142 that do not contact base component 120. In FIG. 3, medial sole portion 314 and lateral sole portion 316 represent two regions or outer peripheral portions of proximal surface 142 that are unattached, do not contact, and/or are uncovered by base component 120. In FIG. 3, medial sole portion 314 extends from a medial peripheral edge 322 of base component 120 to a medial outer edge 324 of proximal surface 142, and lateral sole portion 316 extends from a lateral peripheral edge 332 of base component 120 to a lateral outer edge 334 of proximal surface 142. In other words, in one embodiment, central sole portion 312 is disposed between medial sole portion 314 and lateral sole portion 316.

As noted earlier, in some embodiments, the tensioning system and/or upper can comprise various components or layers. Referring now to the rear isometric view of FIG. 4, it can be seen that upper 102 can comprise at least two structures or components in some embodiments. For example, referring to the cutaway view in FIG. 4, upper 102 includes an interior component 410 and an exterior component 420.

In different embodiments, interior component 410 is an inner layer of upper 102 that can extend along the substantial entirety of interior cavity 202 of article 100. In some embodiments, the inner layer comprising interior component 410 can provide a type of "bootie" structure within article 100. In one embodiment, interior component 410 can substantially surround or bound interior cavity 202 in article 100. In some embodiments, interior component 410 may be made from an elastic, foam, polymer, and/or mesh material. In different embodiments, interior component 410 may be made from any one or a combination of elastic or stretchable materials, including, but not limited to, woven synthetic fibers, polyurethane, nylon, cotton, spandex, neoprene, and other natural and synthetic materials. In other embodiments, interior component 410 can comprise compressible materials or cushioning materials, such as foam.

Furthermore, exterior component 420 can comprise a first layer 422 and a second layer 424 in some embodiments. In one embodiment, first layer 422 comprises an outer layer of upper 102. In some embodiments, first layer 422 forms at least a portion of the exterior-facing surface of article 100. In addition, in some embodiments, second layer 424 comprises an intermediate layer that is disposed or extends between interior component 410 and first layer 422.

Figure 4:
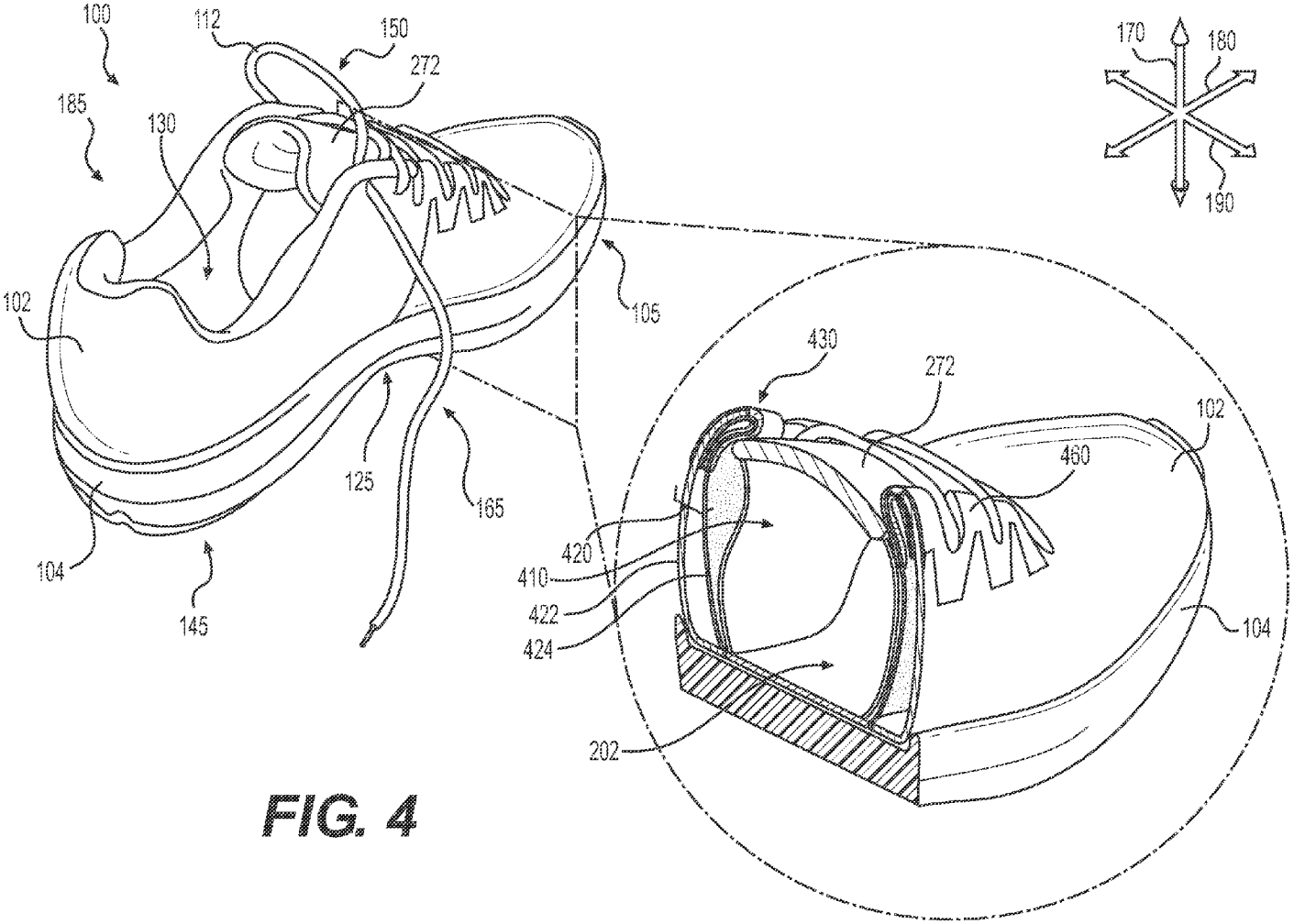
FIG. 4 is an isometric side view of an embodiment of an article of footwear with a view of the interior of the article of footwear.

In different embodiments, first layer 422 and second layer 424 can be disposed to form a substantially continuous surface of upper 102. In one embodiment, a portion of first layer 422 and a portion of second layer 424 can be attached or joined together. For example, in some embodiments, an edge of first layer 422 can abut an edge of second layer 424. However, in other embodiments, as shown in FIG. 4, a portion of first layer 422 can overlap or be covered by a portion of second layer 424. The stacking of different layers of upper 102 will be discussed in greater detail below with respect to FIG. 10.

In different embodiments, exterior component 420 may include folded regions 430. Folded regions 430 can help to form a lacing region in article 100 in some embodiments. In one embodiment, each of folded regions 430 includes the region of overlap between first layer 422 and second layer 424 noted above. In addition, in some embodiments, folded regions 430 can further include an overlay components 460 and form a laminated structure, as will be discussed below with respect to FIGS. 9 and 10. Overlay component 460 can comprise an outermost covering over and/or portions of exterior component 420 in some embodiments.

Figure 5:
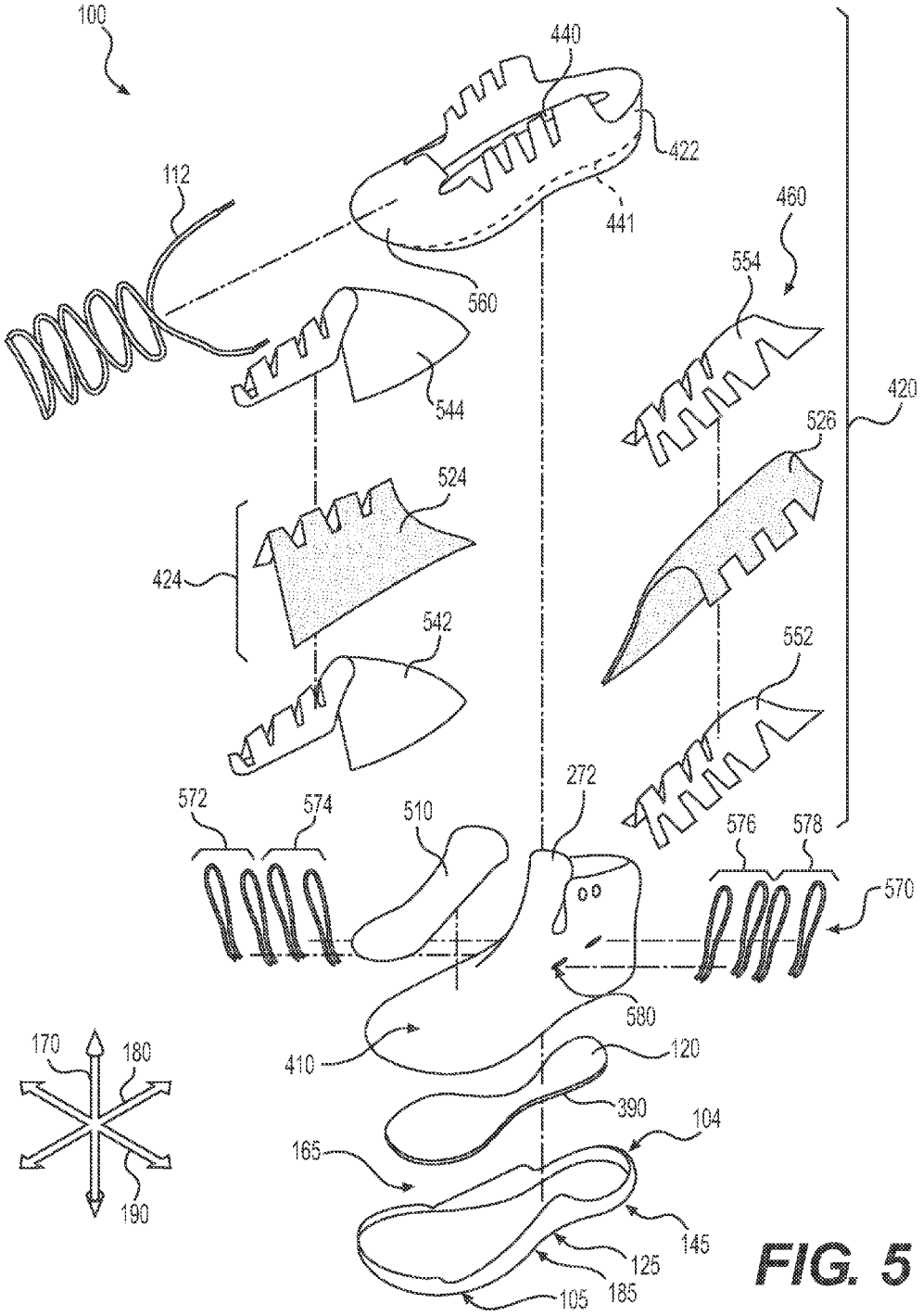
FIG. 5 is an exploded view of an embodiment of an article of footwear.

For purposes of clarity, in FIG. 5, an embodiment of an exploded view of article 100 is depicted. It should be understood that FIG. 5 is provided as an example only, and that other embodiments of article 100 may include components or materials not illustrated herein, or may omit some components that are shown in FIG. 5. As noted above, article 100 comprises upper 102 and sole structure 104. In some embodiments, upper 102 may include one or more components. In the exploded view, it can be seen that adjacent to and disposed directly above sole structure 104 is base component 120. In addition, as described earlier with respect to FIG. 3, in some embodiments, upper 102 can include interior component 410, depicted in FIG. 5 as a bootie-like structure. In addition, it can be seen that in some embodiments, interior component 410 may comprise tongue 272. Tongue 272 may be an integrated tongue in some embodiments, such that the tongue is formed of substantially the same materials as the remainder of interior component 410, and/or extends continuously from the structure of interior component 410. Furthermore, in some embodiments, tongue 272 may also include a tongue covering 510. Tongue covering 510 may comprise material substantially similar to that of first layer 422 in some embodiments, though in other embodiments, the materials of tongue covering 510 and first layer 422 can differ. In other embodiments, tongue 272 may not have a tongue covering.

Though an isometric side view of interior component 410 is shown in FIG. 5, it should be understood that in different embodiments, the bottom surface of interior component 410 can be open or discontinuous. In other words, as shown in the cross section of FIG. 4, the bottom edges of interior component 410 may not extend across the entirety of the bootie structure from medial side 165 to lateral side 185, and instead can have edges that are attached to peripheral border 390 of base component 120. In other embodiments, though, interior component 410 may form a continuous bootie with a sole portion that extends or is continuous along the bottom of the bootie from medial side 165 to lateral side 185.

In addition, disposed above interior component 410, a medial intermediate portion 524 and a lateral intermediate portion 526 are shown. Medial intermediate portion 524 and lateral intermediate portion 526 each comprise a portion of second layer 424. While medial intermediate portion 524 and lateral intermediate portion 526 are shown as two distinct, separate pieces in FIG. 5, it should be understood that in other embodiments, medial intermediate portion 524 and lateral intermediate portion 526 may be joined together and be formed of a single, continuous material. In some embodiments, medial intermediate portion 524 and lateral intermediate portion 526 may be joined along heel region 145, such that second layer 424 extends around the rear of article 100, for example, where a heel counter might be positioned. In embodiments where medial intermediate portion 524 and lateral intermediate portion 526 comprise a single piece, the portion joining the two sections can be configured to wrap around the rear of a heel of article 100. In one embodiment, the wrap-around portion can be disposed, anchored, or fixedly attached between interior component 410 and first layer 422 through heel region 145. In addition, it can be seen that in some embodiments, while interior component 410 extends continuously through forefoot region 105, midfoot region 125, and heel region 145, second layer 424 may extend only through midfoot region 125, or through only midfoot region 145 and heel region 145. In other words, second layer 424 may not be disposed in forefoot region 105 in some embodiments. This may also be contrasted with the arrangement of first layer 422, which extends continuously through forefoot region 105, midfoot region 125, and heel region 145. Furthermore, as will be discussed further below, the free or unattached portions of second layer 424 may be arranged to extend only through midfoot region 125. Thus, second layer 424 may be configured to extend and support primarily midfoot region 125 during use of article 100 by a wearer.

In some embodiments, as noted above with respect to the folded region of FIG. 4, there may be a covering material attached to second layer 424 and/or first layer 422, referred to previously as overlay component 460. As shown in FIG. 5, overlay component 460 comprises a proximal medial overlay 542 and a distal medial overlay 544, as well as a proximal lateral overlay 552 and a distal lateral overlay 554. In some embodiments, proximal medial overlay 542 is associated with or disposed above a proximally facing surface of medial intermediate portion 524, and distal medial overlay 544 is associated with or disposed below a distally facing surface of medial intermediate portion 524. Similarly, in some embodiments, proximal lateral overlay 552 is associated with or disposed above a proximally facing surface of lateral intermediate portion 526, and distal lateral overlay 554 is associated with or disposed below a distally facing surface of lateral intermediate portion 526. In other words, in some embodiments, in assembled article 100, proximal medial overlay 542 and distal medial overlay 544 can "sandwich" medial intermediate portion 524, and proximal lateral overlay 552 and distal lateral overlay 554 can "sandwich" lateral intermediate portion 526, forming a set of laminated structures. As will be discussed further below, each of the laminated structures can be configured to provide a lacing region to the article of footwear in some embodiments.

It should be understood that in other embodiments, the laminated structure can include additional layers, and/or the overlap between overlay component 460 and other layers may be discontinuous. For example, in some embodiments, a portion of proximal medial overlay 542 is associated with or disposed above a proximally facing surface of first layer 422, and distal medial overlay 544 is associated with or disposed below a distally facing surface of medial intermediate portion 524. Similarly, in some embodiments, proximal lateral overlay 552 is associated with or disposed above a proximally facing surface of first layer 422, and distal lateral overlay 554 is associated with or disposed below a distally facing surface of lateral intermediate portion 526. In other words, in some embodiments, in assembled article 100, proximal medial overlay 542 and distal medial overlay 544 can "sandwich" portions of first layer 422 and second layer 424, and proximal lateral overlay 552 and distal lateral overlay 554 can "sandwich" portions of first layer 422 and second layer 424. These layers can form a laminated structure in some embodiments, as will be discussed further below with respect to FIGS. 9 and 10.

In some embodiments, first layer 422 can be disposed adjacent to second layer 424 and/or portions of overlay component 460. As shown in the exploded view of FIG. 5, first layer 422 is positioned above second layer 424. In addition, first layer 422 provides a substantially continuous covering that extends around or wraps over a majority of article 100. In some embodiments, first layer 422 can comprise a covering portion 560, as well as medial upper portion 440 and a lateral upper portion 441 (shown in dotted line), where medial upper portion 440 and lateral upper portion 441 each extend inward from a lower portion of covering portion 560, in a generally horizontal direction, attaching directly to proximal surface 142. In some embodiments, covering portion 560 of first layer 422 can be understood to comprise the outermost surface of article 100, covering or encompassing the material of interior component 410 and/or second layer 424.

In addition, article 100 may include other optional features that can provide additional benefits to the tensioning system. In some embodiments, article 100 can include provisions for adjusting the tension along heel region 145. For example, in FIG. 5, a plurality of looped strands ("looped strands") 570 are shown disposed adjacent to interior component 410. Looped strands 570 can be arranged to extend from near peripheral border 390 of base component 120 in some embodiments. In one embodiment, looped strands 570 are located in heel region 145, and extend upward from peripheral border 390 and through a cut, opening, or slot 580 that is formed in the material of upper 102. In some embodiments, looped strands 570 are disposed between interior component 410 and exterior component 420. In one embodiment, slot 580 can be formed through the material comprising exterior component 420, in either or both of first layer 422 and second layer 424. In some cases, looped strands 570 can provide additional eyelets for tensile element 112 in article 100.

In FIG. 5, it can be seen that looped strands 570 include a first medial strand set 572 and a second medial strand set 574, as well as a first lateral strand set 576 and a second lateral strand set 578. In other embodiments, looped strands 570 can be arranged along only medial side 165 or only on lateral side 185, there may be a greater number of looped strands 570 on medial side 165 relative to lateral side 185, or there may be a greater number of looped strands 570 on lateral side 185 relative to medial side 165. In addition, in some embodiments, there may be a slot formed through the material of upper 102 for each looped strand that is fixedly attached to article 100. For example, looped strands comprising first lateral strand set 576 can be anchored near peripheral border 390 of base component 120 on lateral side 185 of article 100, and be routed such that they extend upward and out of a first slot formed in a lateral side of at least first layer 422 of exterior component 420 and looped strands comprising first medial strand set 572 can be anchored near peripheral border 390 of base component 120 on medial side 165 of article 100, and be routed such that they extend upward and out of a second slot formed in a medial side of at least first layer 422 of exterior component 420. In other embodiments, one or more looped strands 570 can be routed such that they emerge through a single slot or opening in upper 102.

Figure 6:
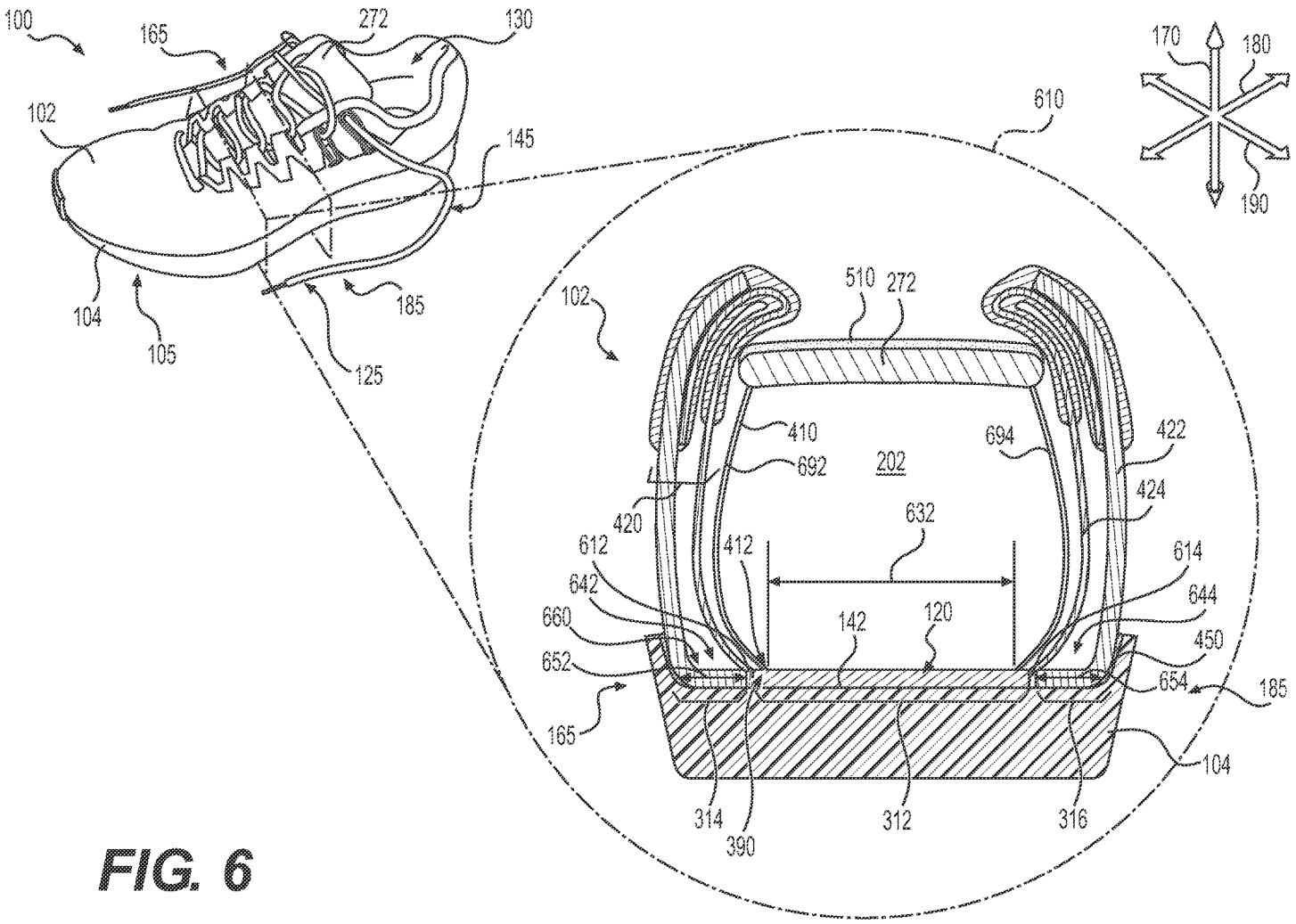
FIG. 6 is an isometric view of an embodiment of an article of footwear and a lateral cross-sectional view of the article of footwear.
Figure 7:
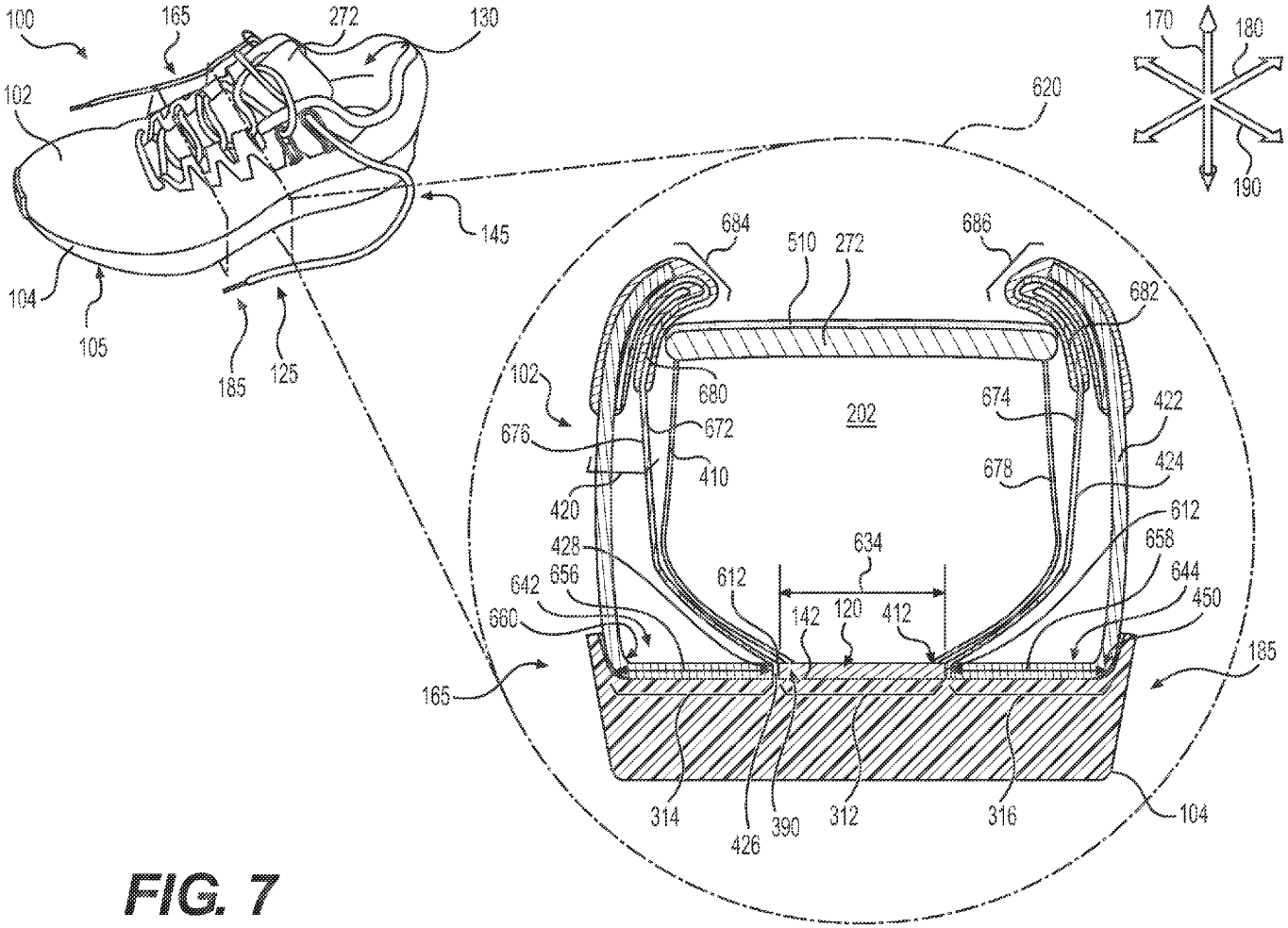
FIG. 7 is an isometric view of an embodiment of an article of footwear and a lateral cross-sectional view of the article of footwear.

Referring now to FIGS. 6 and 7, a lateral isometric view of article 100 is shown with a first cross-sectional view 610 in FIG. 6 and a second cross-sectional view 620 in FIG. 7. First cross-sectional view 610 is taken from a portion of article 100 disposed closer to forefoot region 105 relative to second cross-sectional view 620. As described earlier, proximal surface 142 of sole structure 104 faces toward interior cavity 202 of article 100, and base component 120 is attached to central sole portion 312 of proximal surface 142. It can be seen that—as noted above with respect to FIG. 3—the width of base component 120 can vary through the longitudinal length of article 100. Thus, in first cross-sectional view 610 in FIG. 6, base component 120 has a first base width 632, and in second cross-sectional view 620 in FIG. 7, base component 120 has a second base width 634. In different embodiments, first base width 632 and second base width 634 can differ from one another. In some embodiments, first base width 632 is substantially larger than second base width 634, as shown in FIGS. 6 and 7. However, in other embodiments, first base width 632 may be similar to or smaller than second base width 634.

In addition, in some embodiments, a bottom interior edge 412 of interior component 410 can be fixedly attached to at least a portion of peripheral border 390 of base component 120. As shown in FIG. 6, bottom interior edge 412 of interior component 410 is fixedly attached to and anchored to peripheral border 390. In some embodiments, the entirety of peripheral border 390 of base component 120 can be attached to and/or bordered by bottom interior edge 412 of interior component 410. The remainder of interior component 410 can extend upward and away from base component 120 to form a bootie structure in article 100 in different embodiments. In one embodiment, interior component 410 is anchored only along bottom interior edge 412 through forefoot region 105 and midfoot region 125. In other words, the remainder of interior component 410 is free or moveable throughout at least forefoot region 105 and midfoot region 125, allowing interior component 410 to readily accommodate differently shaped feet.

In addition, as shown in FIG. 7, in one embodiment, an inner edge 428 of first layer 422 can be disposed adjacent to portions of proximal surface 142. As shown in FIG. 6, in some embodiments, inner edge 428 of first layer 422 can also be attached near, around, or to peripheral border 390 of base component 120. In addition, in one embodiment, inner edge 428 of first layer 422 can be disposed adjacent to bottom interior edge 412 of interior component 410 and/or bottom intermediate edge 426 of second layer 424. In some embodiments, bottom intermediate edge 426 and/or bottom interior edge 412 can be attached together with inner edge 428 along peripheral border 390 of base component 120. However, in other embodiments, bottom intermediate edge 426 or bottom interior edge 412 can be attached in separate regions from inner edge 428 along the base of interior cavity 202.

Furthermore, in some embodiments, first layer 422 can also be attached around or to an outer edge 450 of proximal surface 142 of sole structure 104. In addition, first layer 422 can include portions that are attached directly to proximal surface 142. For example, in FIGS. 6 and 7, it can be seen that first layer 422 of exterior component 420 has: (a) a medial upper portion 642 that extends along the proximal sole surface 142 from the peripheral edge 390 of the strobel 120 to the medial outer edge 450 of the proximal sole surface 142, and (b) a lateral upper portion 644 that extends along the proximal sole surface 142 from the peripheral edge 390 of the strobel 120 to the lateral outer edge 450 of the proximal sole surface 142.

In some embodiments, medial upper portion 642 is disposed atop of and/or can be fixedly attached to medial sole portion 314 of proximal surface 142. In addition, lateral upper portion 644 can be disposed atop of and/or be fixedly attached to medial sole portion 314 of proximal surface 142 in some embodiments. In other words, in one embodiment, first layer 422 extends downward in a direction generally aligned with vertical axis 170 along both medial side 165 and lateral side 185 of upper 102, and then is bent inward along a curved portion 660, toward a center of interior cavity 202, in a direction generally aligned with lateral axis 190. In some embodiments, first layer 422 can extend inward toward base component 120. In some embodiments, lateral upper portion 644 is disposed adjacent to a lateral peripheral edge of base component 120, and medial upper portion 642 is disposed adjacent to a medial peripheral edge of base component 120.

In some embodiments, as the width of base component 120 changes, the corresponding widths or dimensions of other regions in article 100 may change as well. For example, medial upper portion 642 has a first upper width 652 and lateral upper portion 644 has a second upper width 654 in first cross-sectional view 610 of FIG. 6. In addition, in second cross-sectional view 620 of FIG. 7, medial upper portion 642 has a third upper width 656 and lateral upper portion 644 has a fourth upper width 658. Referring to each of these sections, it can be seen that the widths of different portions of first layer 422 can differ in some embodiments. In FIGS. 6 and 7, first upper width 652 is smaller than third upper width 656, and second upper width 654 is smaller than fourth upper width 658. In some embodiments, in regions where base component 120 is wider, each corresponding medial upper portion and lateral upper portion can be more narrow.

In addition, in different embodiments, second layer 424 can include provisions for being joined to other portions of article 100. In some embodiments, intermediate or second layer 424 can include attachment portions that may attach directly to or adjacent to peripheral border 390 of base component 120, between base component 120 and first layer 422. In addition, in one embodiment, the attachment portions of second layer 424 can be disposed directly adjacent to bottom interior edge 412 of interior component 410. In some embodiments, the attachment portions and bottom interior edge 412 can be attached together along peripheral border 390 of base component 120. However, in other embodiments, the attachment portions and bottom interior edge 412 can be attached in separate regions along the base of interior cavity 202.

In some embodiments, as shown in FIGS. 6 and 7, the attachment portions can comprise a lateral attachment portion 614 and a medial attachment portion 612. In some embodiments, lateral attachment portion 614 represents the region of second layer 424 that is fixedly attached to the peripheral border of base component 120 on lateral side 185, and the medial attachment portion 612 represents the region of second layer 424 that is fixedly attached to the peripheral border of base component 120 on medial side 165. In one embodiment, medial attachment portion 612 is attached along a medial peripheral border of base component 120 (representing the outer thickness or lateral sidewall of the base component) and lateral attachment portion 614 is attached along a lateral peripheral border of base component 120 (representing the outer thickness or medial sidewall of the base component). However, in other embodiments, the medial attachment portion and the lateral attachment portion of second layer 424 can be attached in different locations in article 100. For example, in some embodiments, medial attachment portion 612 can be attached along or adjacent to peripheral border 390 of base component 120. In another embodiment, medial attachment portion 612 can be attached to medial upper portion 642 of first layer 422, for example. In other embodiments, the attachment portions of second layer 424 may be attached to portions of interior component 410.

Similarly, in different embodiments, the bootie structure comprising interior component 410 can be anchored or fixedly attached to different portions of article 100. In some embodiments, interior component 410 can include a medial bottom edge portion and a lateral bottom edge portion. In some embodiments, the lateral bottom edge portion represents the region of bottom interior edge 412 of interior component 410 that is attached to the peripheral border of base component 120 on lateral side 185, and the medial bottom edge portion represents the region of bottom interior edge 412 of interior component 410 that is attached to the peripheral border of base component 120 on medial side 165. In one embodiment, the medial bottom edge portion is attached along peripheral border 390 on medial side 165 of base component 120, and the lateral bottom edge portion is attached along peripheral border 390 on lateral side 185 of base component 120. However, in other embodiments, the medial bottom edge portion and the lateral bottom edge portion of interior component 410 can be attached in different locations in article 100. For example, in some embodiments, the bottom edge portions can be attached to an upper portion of first layer 422. In other embodiments, the bottom edge portions may be attached to portions of second layer 424.

In addition, in some embodiments, interior component 410 can extend upward from the medial bottom edge portion toward tongue 272 on medial side 165 of article 100, and also extend from the lateral bottom edge portion toward tongue 272 on lateral side 185 of article 100. In one embodiment, as shown in first cross-sectional view 610 of FIG. 6, it can be seen that interior component 410 can comprise a medial bootie portion 692 and a lateral bootie portion 694. Medial bootie portion 692 extends from the medial bottom edge portion toward and adjacent to tongue 272. In addition, lateral bootie portion 694 extends from the lateral bottom edge portion toward and adjacent to tongue 272. In some embodiments, medial bootie portion 692 and lateral bootie portion 694 each represent the portions of interior component 410 that are unattached to other components or materials of article 100. In other words, medial bootie portion 692 and lateral bootie portion 694 are substantially free to move, shift, bend, and/or deform in response to an applied force.

Similarly, in some embodiments, second layer 424 can extend upward from the medial attachment portion toward tongue 272 on medial side 165 of article 100, and from the lateral attachment portion toward tongue 272 on lateral side 185 of article 100. In one embodiment, as shown in second cross-sectional view 620 of FIG. 7, it can be seen that second layer 424 can comprise a medial side portion 672 and a lateral side portion 674. Medial side portion 672 extends from medial attachment portion 612 toward and into a medial laminated structure 684. In addition, lateral side portion 674 extends from lateral attachment portion 614 toward and into a lateral laminated structure 686. For purposes of reference, medial side portion 672 can be divided into a medial free portion 676 and a medial laminated portion 680, and lateral side portion 674 can be divided into a lateral free portion 678 and a lateral laminated portion 682. Medial free portion 676 and lateral free portion 678 each represent the portions of second layer 424 that are unattached to other components or materials of article 100. In other words, medial free portion 676 and lateral free portion 678 are substantially free to move, shift, bend, and/or deform in response to an applied force. Furthermore, medial laminated portion 680 and lateral laminated portion 682 each represent the portions of second layer 424 that are disposed within a laminated structure. In other words, medial laminated portion 680 is disposed within medial laminated structure 684 and lateral laminated portion 682 is disposed within lateral laminated structure 686. Thus, medial free portion 676 can be understood to extend from medial attachment portion 612 to medial laminated portion 680, and lateral free portion 678 can be understood to extend from lateral attachment portion 614 to lateral laminated portion 682. The laminated structures will be discussed further below with respect to FIGS. 9 and 10.

Figure 8:
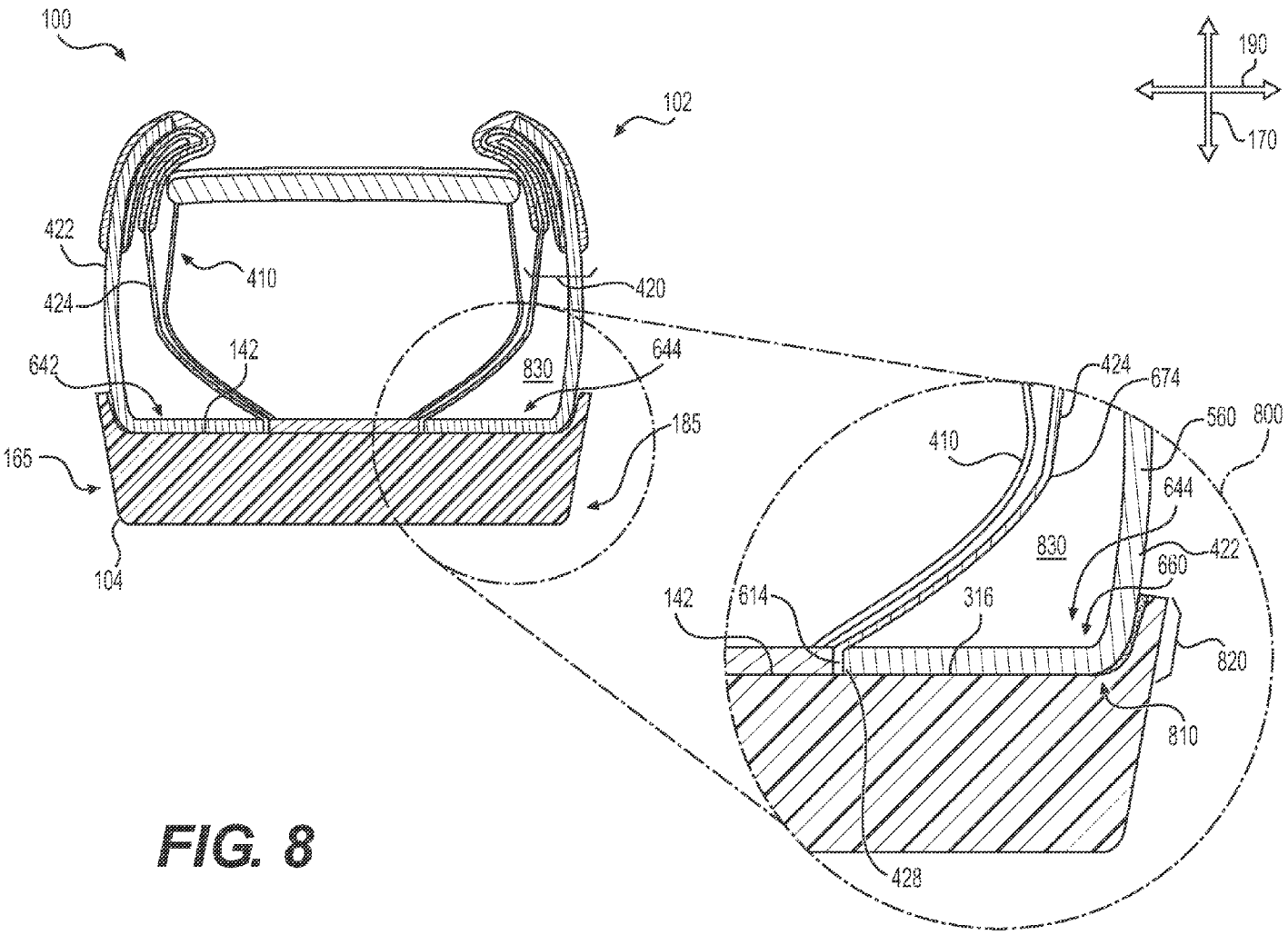
FIG. 8 is a cross-sectional view of an embodiment of a midfoot region in an article of footwear.

Referring now to FIG. 8, the cross-sectional view of FIG. 7 is illustrated with a magnified region 800 for purposes of clarity. In magnified region 800, it can again be seen that the layers comprising exterior component 420 are anchored or secured in different locations. In some embodiments, lateral upper portion 644 of first layer 422 can extend from an outer edge 810 to inner edge 428. Outer edge 810 is the edge associated with the bending region of curved portion 660 of first layer 422 in FIG. 8. In addition, in one embodiment, outer edge 810 is disposed along or adjacent to an outer periphery 820 of sole structure 104. A distal side of lateral upper portion 644 faces lateral sole portion 316 of proximal surface 142. Furthermore, in FIG. 8, second layer 424 of exterior component 420 is attached to base component 120 along its lateral attachment portion, as described above in FIGS. 6 and 7. Thus, it can be seen that in some embodiments, while inner edge 428 and lateral side portion 674 may be adjacent to one another, a majority of the remainder of the two layers are spaced apart. In other words, a hollow region 830 or volume can exist between lateral side portion 674 and covering portion 560. While the surfaces of lateral side portion 674 and covering portion 560 may contact one another during use of article 100, it can be understood that in a neutral state, there may be a space between the free portions of second layer 424 and covering portion 560, where the space is at least partially determined by a width of lateral upper portion 644. In different embodiments, the different widths associated through the length of the medial upper portion and the lateral upper portion can partially bound a continuous chamber or spacing between first layer 422 and second layer 424 of exterior component 420. It should be understood that while only lateral side 185 is described in FIG. 8, in other embodiments, medial side 165 may include substantially similar features and components.

Figure 9:
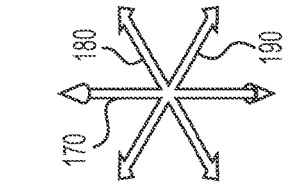
FIG. 9 is an isometric side view of an embodiment of an article of footwear.
Figure 9:
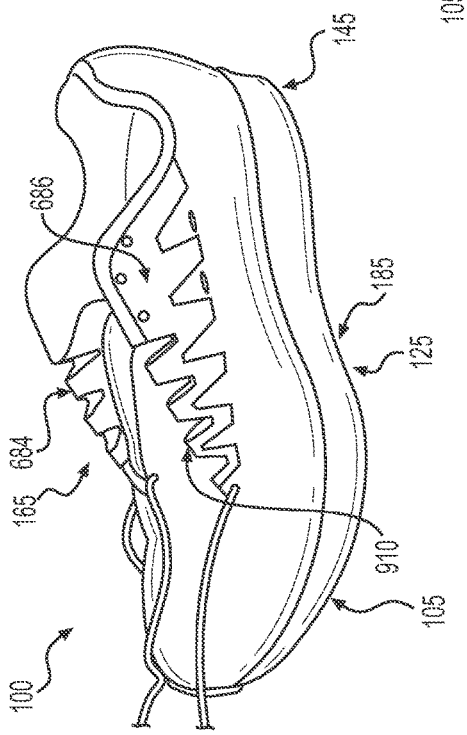

In FIG. 9, an isometric lateral view of article 100 is depicted in order to better illustrate an embodiment of a laminated structure. In FIG. 9, lateral laminated structure 686 is shown on lateral side 185, and medial laminated structure 684 is shown on the opposite, medial side 165 of article 100. For purposes of this description, a laminated structure refers to a multilayered component or portion of the article of footwear. In different embodiments, the laminated structure can provide a lacing region in article 100 through which a lace or other tensile element can be routed. In the embodiment of FIG. 9, lateral laminated structure 686 can be seen to include a series of undulations. The laminated structures can have any desired shape, size, or design, including regular and irregular shapes. In addition, lateral laminated structure 686 includes a folded region 910, along which the laminated structure is substantially bent and curves back upon itself.

Figure 10:
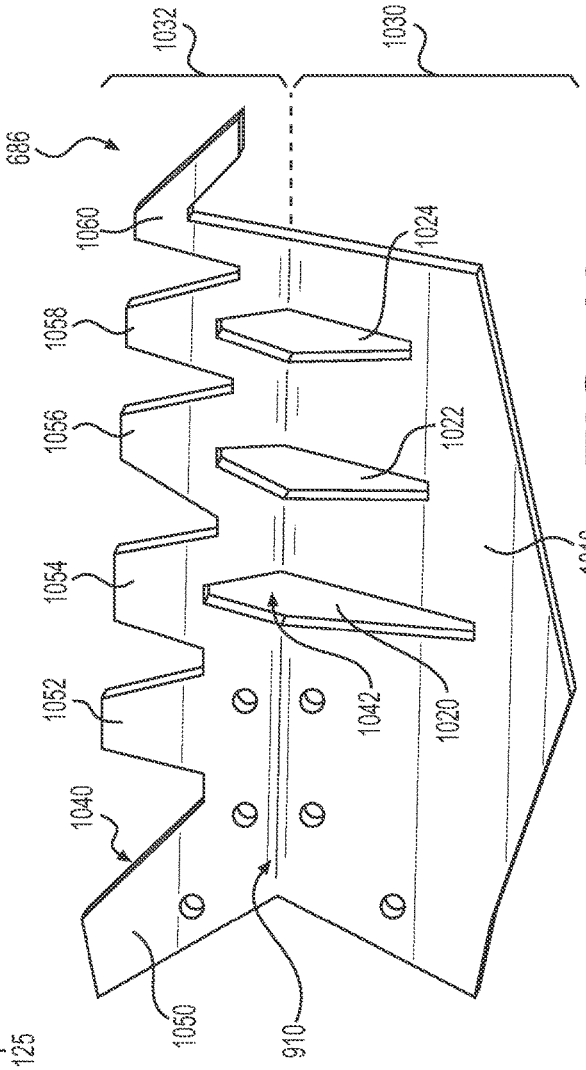
FIG. 10 is a top-down view of an embodiment of a portion of a lacing region of the article of footwear of FIG. 9.

Referring now to FIG. 10, an "opened" or flattened top-down view of lateral laminated structure 686 is illustrated in isolation for purposes of clarity. It should be understood that while only lateral laminated structure 686 is described in detail in FIG. 10, in other embodiments, the medial laminated structure may include substantially similar features, design, layers, or components. However, in other embodiments, the medial laminated structure may differ in size, shape, and arrangement, or there may be only a single laminated structure in the article of footwear.

In FIG. 10, the top-down view depicts a top overlay layer 1010 that provides an outermost covering for lateral laminated structure 686. Furthermore, the shape of lateral laminated structure 686 is irregular, and includes four substantially smooth sides in a lower segment 1030 and a plurality of arm portions ("arm portions") 1040 in an upper segment 1032, where lower segment 1030 and upper segment 1032 may be understood to be demarcated by the area associated with first folded region 910. Though the number and size of arm portions 1040 can differ in other embodiments, in FIG. 10, it can be seen that arm portions 1040 include a first arm 1050, a second arm 1052, a third arm 1054, a fourth arm 1056, a fifth arm 1058, and a sixth arm 1060. Some arm portions may include a generally trapezoidal shape, though in other embodiments, the arm portions can have any shape, including round, square, elliptical, rectangular, or any other regular or irregular shape. Furthermore, in some embodiments, such as sixth arm 1060, an arm portion may comprise a substantially elongated and/or bent portion of the laminated structure.

In addition, in some embodiments, a laminated structure can include provisions for routing a tensile element. For example, in some embodiments, the laminated structure may include openings or apertures 1042 formed through the layers comprising the laminated structure. In FIG. 10, lateral laminated structure 686 includes a first aperture 1020, a second aperture 1022, and a third aperture 1024. Each aperture can vary in size and shape. In FIG. 10, first aperture 1020 has a greater length relative to either second aperture 1022 and third aperture 1024. As shown in FIG. 9, when lateral laminated structure 686 is folded, apertures 1042 can provide openings through which a tensile element can enter or exit. Furthermore, arm portions 1040, when folded, can provide a channel or tunnel for the tensile element to engage with and be secured through. In other words, through the inclusion of arm portions 1040 and apertures 1042, the laminated structures can form a series of eyelets, and at least partially provide a lacing region in article 100 in some embodiments.

Figure 11:
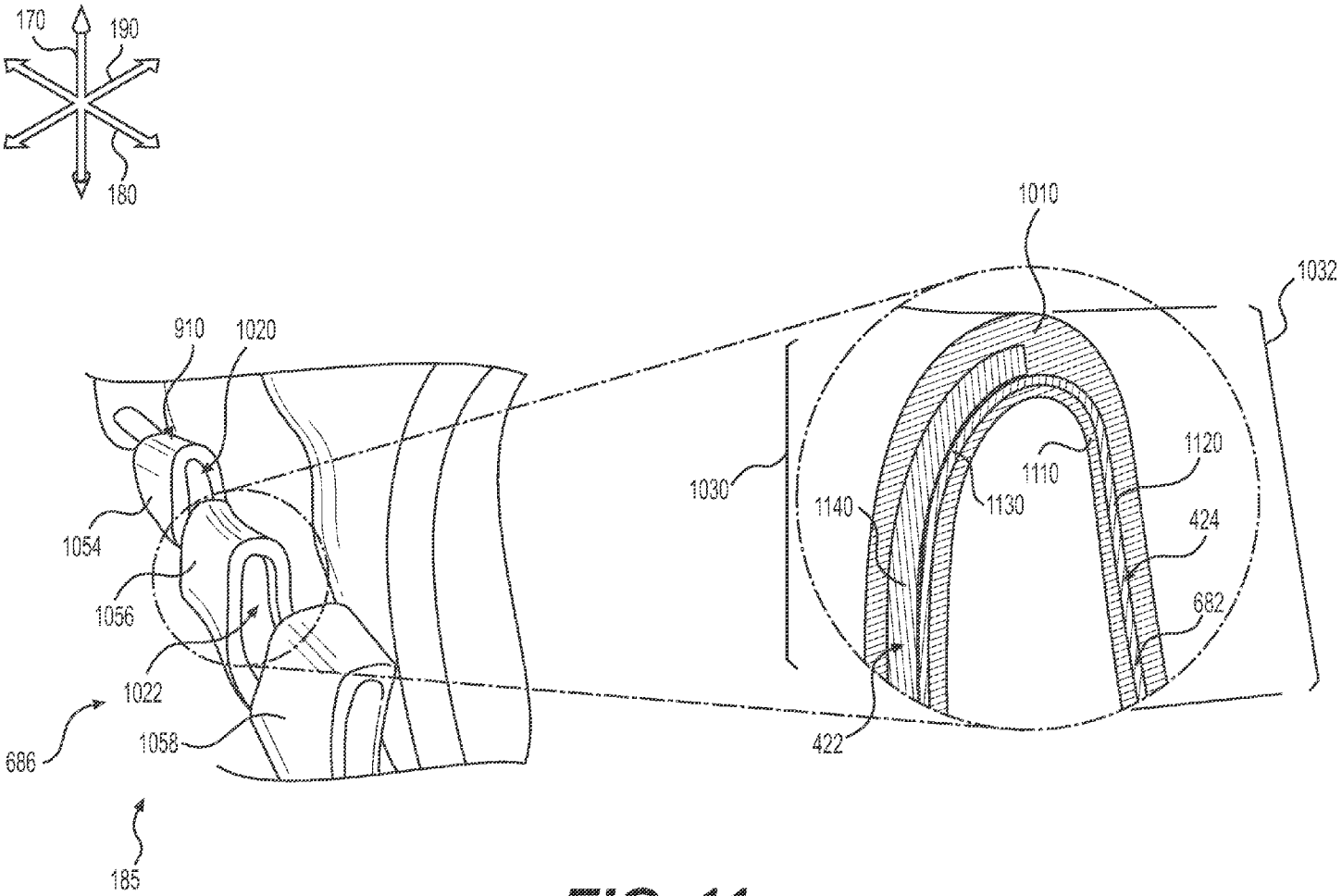
FIG. 11 is an isometric side view and cross section of an embodiment of a portion of a lacing region of an article of footwear.

Referring now to FIG. 11, a magnified view of a portion of lateral laminated structure 686 is depicted including third arm 1054, fourth arm 1056, and fifth arm 1058, as well as first aperture 1020 and second aperture 1022. In order to better understand the layered configuration of the laminated structures, a cross-sectional view is also included in FIG. 11. In the cross-sectional view, it can be seen that in some embodiments, the outermost proximal surface (with a generally convex configuration) of lateral laminated structure 686 can include top overlay layer 1010, and the outermost distal surface (with a generally concave configuration) includes bottom overlay layer 1110. In addition, disposed between top overlay layer 1010 and bottom overlay layer 1110 in lower segment 1030 is a first portion 1120 of lateral laminated portion 682 of second layer 424. In some embodiments, additional materials or layers may be disposed between top overlay layer 1010 and bottom overlay layer 1110, and/or second layer 424 may not be disposed within the layers of the laminated structure.

Furthermore, disposed between top overlay layer 1010 and bottom overlay layer 1110 in upper segment 1032 is a second portion 1130 of lateral laminated portion 682 of second layer 424. It should be understood that in some embodiments, first portion 1120 and second portion 1130 comprise a continuous piece. In some embodiments, additional materials or layers may be disposed between top overlay layer 1010 and bottom overlay layer 1110. For example, disposed between top overlay layer 1010 and second portion 1130 is a laminated upper portion 1140. In other words, in some embodiments, a portion of first layer 422 may be disposed in the laminated structure. In other embodiments, first layer 422 may not extend through the laminated structure, or the material of first layer 422 may also extend in both upper segment 1032 and lower segment 1030 of the laminated structure. Thus, in one embodiment, lateral laminated structure 686 can include a top overlay layer 1010 that is directly and fixedly attached to and/or lays directly against a distal surface of laminated upper portion 1140 of first layer 422. In addition, in some embodiments, laminated upper portion 1140 of first layer 422 can be directly and fixedly attached to and/or lay directly against a distal surface of second portion 1130 of second layer 424. Furthermore, in one embodiment, second portion 1130 of second layer 424 may be directly attached to and/or lay directly against a distal surface of bottom overlay layer 1110. In different embodiments, the inclusion of various layers in the laminated structures can strengthen the lacing region and improve durability and resilience through repeated use of the laminated structure with a tensile element. Furthermore, the inclusion of first layer 422 and second layer 424 can improve the ability of the tensioning system to provide support and stability to the article of footwear.

Figure 13:
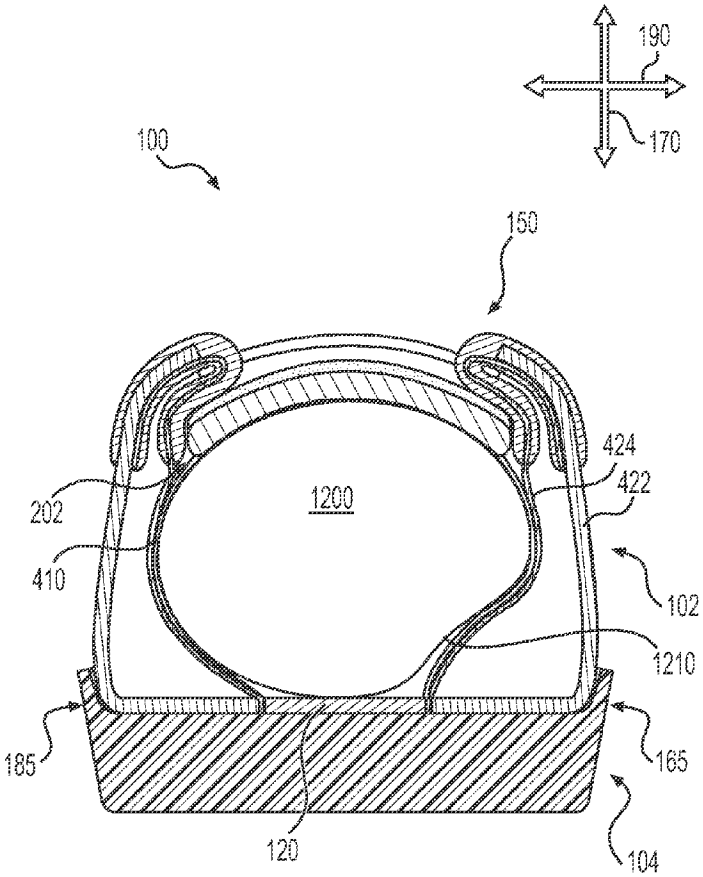
FIG. 13 is a cross-sectional view of an embodiment of a portion of an article of footwear and a foot when the article of footwear is in a tightened state.
Figure 12:
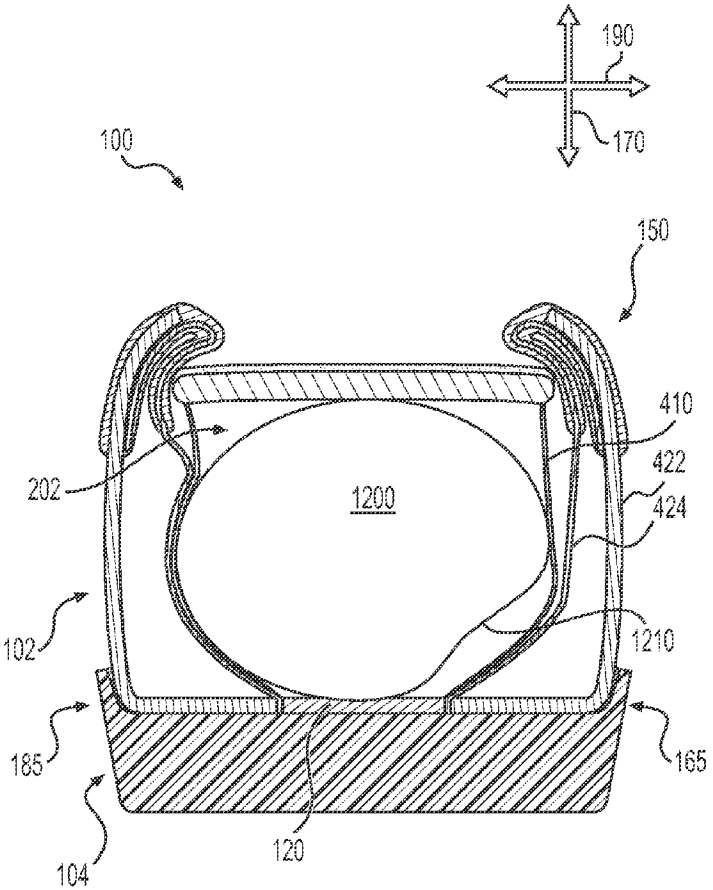
FIG. 12 is a cross-sectional view of an embodiment of a portion of an article of footwear and a foot when the article of footwear is in a loosened state.

In FIGS. 12 and 13, two cross-sectional views of article 100 are is provided. FIG. 12 depicts an embodiment of a loosened configuration of article 100 with a foot 1200 disposed within interior cavity 202, and FIG. 13 depicts an embodiment of a tensioned configuration of article 100 with foot 1200 disposed within interior cavity 202. In some embodiments, the various layers comprising upper 102 may extend to an underside 1210 of the foot, such that a portion of one or more of the layers or components underlie or extend underneath the foot of a wearer when foot 1200 is disposed within interior cavity 202. In some embodiments, due in part to the substantially narrow width of base component 120 through certain regions of article 100, interior component 410 may extend along medial side 165, lateral side 185, and underside 1210 of foot 1200.

In some embodiments, tensioning system 150 may be configured to provide support to different regions of a foot of a wearer. In some embodiments, tensioning system 150 may be arranged so as to substantially support the foot of a wearer. In one exemplary embodiment, second layer 424 can wrap around foot 1200, extending along both medial side 165 and lateral side 185, as well as underside 1210, helping to support regions of a foot of a wearer generally corresponding to the midfoot region.

In some embodiments, the midfoot region may be associated with an arch of the foot. In FIG. 5, it was noted that second layer 424 may be disposed to extend primarily or solely through midfoot region 125. In particular, the free portions (i.e., medial free portion 676 and lateral free portion 678 described in FIG. 6) of second layer 424 may extend through midfoot region 125. Thus, in some embodiments, second layer 424 may be configured as an arch member to provide support to midfoot region 125 of the wearer's foot. As the article is tightened and transitions from the loosened configuration of FIG. 12 to the tensioned configuration of FIG. 13, it can be seen that interior component 410 and/or second layer 424 may be configured as an arch member to provide support to the midfoot region of the wearer's foot. In some embodiments, an arch member may extend underneath the foot of a wearer to support the arch of the foot. In some other embodiments, portions of second layer 424 may be configured as a heel member to provide support to the heel region of the wearer's foot. In other words, as article 100 is tightened, the slack associated with the free portions of second layer 424—which are attached to the laminated structures comprising the lacing region of article 100—is pulled and made taut. Similarly, because second layer 424 substantially surrounds and is disposed directly adjacent to the midfoot region of interior component 410, the slack associated with the bootie structure surrounding foot 1200 is also pulled taut. Together, second layer 424 and interior component 410 can surround and/or encase foot 1200 and provide stability and support to portions of the foot. Through the use of this type of tensioning system, different foot shapes and volumes can be supported and secured comfortably in article 100. In some embodiments, article 100 can provide a kind of adaptive tensioning for a user, which "hugs" or embraces portions of the unique shapes of an individual's foot.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, comprising:

a forefoot region, a midfoot region, a heel region, a lateral side, and a medial side;

an upper, a sole structure, and a strobel;

the sole structure including a proximal sole surface, the proximal sole surface facing toward an interior cavity of the article of footwear;

the strobel being attached to a central sole portion of the proximal sole surface;

the upper comprising an interior component and an exterior component;

the interior component comprising a bootie configured to receive a foot, wherein a first bottom edge of the interior component is attached to a peripheral edge of the strobel;

the exterior component comprising a first layer, a second layer, and two laminated structures, wherein the first layer forms an exterior-facing surface of the article of footwear, wherein the first layer of the exterior component of the upper includes: (a) a lateral upper portion that extends along the proximal sole surface from the peripheral edge of the strobel to a lateral outer edge of the proximal sole surface, and (b) a medial upper portion that extends along the proximal sole surface from the peripheral edge of the strobel to a medial outer edge of the proximal sole surface; and the second layer being disposed between the interior component and the first layer, wherein a second bottom edge of the second layer is attached to the peripheral edge of the strobel, the second bottom edge of the second layer being disposed adjacent to the first bottom edge of the interior component.

2. The article of footwear of claim 1, wherein each of the two laminated structures comprises a layered structure that includes a top overlay layer, a bottom overlay layer, a portion of the first layer, and a portion of the second layer.

3. The article of footwear of claim 1, wherein the proximal sole surface has a first width in the midfoot region, the strobel has a second width in the midfoot region, and wherein the first width is substantially larger than the second width.

4. The article of footwear of claim 1, wherein the two laminated structures include a lateral laminated structure disposed on the lateral side and a medial laminated structure disposed on the medial side.

5. The article of footwear of claim 1, wherein each of the two laminated structures comprises a plurality of apertures configured to receive a lacing element.

6. The article of footwear of claim 4, wherein the lateral laminated structure includes a folded edge.

7. The article of footwear of claim 1, wherein the interior component further comprises an integrated tongue.

8. An article of footwear, comprising:

a forefoot region, a midfoot region, and a heel region;

an upper, a sole structure, and a strobel;

the sole structure including a proximal sole surface, the proximal sole surface facing toward an interior cavity of the article of footwear, the proximal sole surface comprising a medial sole portion, a central sole portion, and a lateral sole portion, the central sole portion extending between the medial sole portion and the lateral sole portion and spaced inward from a lateral outer edge and a medial outer edge of the proximal sole surface;

the strobel being attached to the central sole portion of the proximal sole surface;

the upper comprising an outer layer, an intermediate layer, and an inner layer, wherein a majority of the intermediate layer is disposed between the outer layer and the inner layer;

the inner layer forming a bootie, the bootie being configured to receive a foot;

the outer layer comprising a medial upper portion, a covering portion, and a lateral upper portion;

the medial upper portion of the outer layer being attached to the medial sole portion of the proximal sole surface, and the lateral upper portion of the outer layer being attached to the lateral sole portion of the proximal sole surface;

wherein the lateral upper portion extends from the lateral outer edge of the proximal sole surface to a lateral peripheral edge of the strobel, and wherein the medial upper portion extends from the medial outer edge of the proximal sole surface to a medial peripheral edge of the strobel;

the intermediate layer comprising a medial attachment portion and a lateral attachment portion, wherein the lateral attachment portion is attached to the strobel at the lateral peripheral edge of the strobel, and wherein the medial attachment portion is attached to the strobel at the medial peripheral edge of the strobel;

the intermediate layer further comprising a medial side portion and a lateral side portion, the medial side portion including a medial free portion and a medial laminated portion, the medial free portion extending from the medial attachment portion to the medial laminated portion; and the medial laminated portion being disposed within a medial laminated structure.

9. The article of footwear of claim 8, wherein the proximal sole surface has a first width in the midfoot region, the strobel has a second width in the midfoot region, and wherein the first width is substantially larger than the second width.

10. The article of footwear of claim 9, wherein the medial upper portion has a third width in the midfoot region, the lateral upper portion has a fourth width in the midfoot region, and wherein the third width and the fourth width together comprise the first width.

11. The article of footwear of claim 8, wherein the medial laminated structure comprises a plurality of apertures.

12. The article of footwear of claim 11, wherein the medial laminated structure is folded and forms a plurality of channels configured to receive a lacing element.

13. The article of footwear of claim 8, wherein the medial laminated structure includes a top overlay layer, a bottom overlay layer, and the medial laminated portion.

14. The article of footwear of claim 13, wherein the top overlay layer provides an exterior-facing surface of the upper.

15. An article of footwear, comprising:

a forefoot region, a midfoot region, and a heel region;

an upper, a sole structure, and a strobel;

the sole structure including a proximal sole surface, the proximal sole surface facing toward an interior cavity of the article of footwear;

the strobel being attached to a central sole portion of the proximal sole surface;

the upper comprising an interior component and an exterior component;

the interior component comprising a bootie configured to receive a foot, wherein a first bottom edge of the interior component is attached to a peripheral edge of the strobel;

the exterior component comprising a first layer, a second layer, and two laminated structures, wherein the first layer forms an exterior-facing surface of the article of footwear, wherein a first edge of the first layer is disposed adjacent to a second edge of the second layer, and wherein the first layer of the exterior component of the upper includes: (a) a lateral upper portion that extends along the proximal sole surface from the peripheral edge of the strobel to a lateral outer edge of the proximal sole surface, and (b) a medial upper portion that extends along the proximal sole surface from the peripheral edge of the strobel to a medial outer edge of the proximal sole surface;

the second layer being disposed between the interior component and the first layer, wherein a second bottom edge of the second layer is attached to the peripheral edge of the strobel, the second bottom edge of the second layer being disposed adjacent to the first bottom edge of the interior component; and wherein the first layer extends through the forefoot region, the midfoot region, and the heel region, and the second layer extends through the midfoot region and heel region.

16. The article of footwear of claim 15, wherein each of the two laminated structures includes a top overlay layer, a bottom overlay layer, a portion of the first layer, and a portion of the second layer.

17. The article of footwear of claim 15, further comprising a first looped strand and a second looped strand, the first looped strand being anchored along the peripheral edge of the strobel on a lateral side of the article of footwear, and the second looped strand being anchored along the peripheral edge of the strobel on a medial side of the article of footwear.

18. The article of footwear of claim 17, wherein the first looped strand extends through a first slot formed in the first layer on the lateral side, and wherein the second looped strand extends through a second slot formed in the first layer on the medial side.

19. The article of footwear of claim 15, wherein the second layer wraps around the heel region and wherein the second layer extends from a medial side of the upper to a lateral side of the upper.

* * * * *